US005996838A

United States Patent [19]

Bayer et al.

[11] Patent Number: 5,996,838

[45] Date of Patent: Dec. 7, 1999

[54] VENDING MACHINE

[75] Inventors: Josef Bayer; Klaus Kracher, both of Herrieden, Germany

[73] Assignee: Sielaff GmbH & Co., Germany

[21] Appl. No.: 08/980,001

[22] Filed: Nov. 26, 1997

[30] Foreign Application Priority Data

Nov. 28, 1996 [DE] Germany ..... 296 20 666

[51] Int. Cl.[6] ..... G07F 11/00

[52] U.S. Cl. ..... 221/75; 221/130; 221/131; 221/241

[58] Field of Search ..... 221/75, 130, 131, 221/241, 242, 92

[56] References Cited

U.S. PATENT DOCUMENTS

| | | | |
|---|---|---|---|
| 3,883,038 | 5/1975 | Bookout | 221/242 |
| 3,989,163 | 11/1976 | Wittern | 221/75 |
| 4,368,829 | 1/1983 | Lotspeich et al. | 221/75 |
| 4,560,088 | 12/1985 | Tan | 221/75 |
| 4,600,119 | 7/1986 | Olson | 221/75 |
| 5,533,645 | 7/1996 | Wittern, Jr. et al. . | |

FOREIGN PATENT DOCUMENTS

| | | | |
|---|---|---|---|
| 0244990 | 11/1987 | European Pat. Off. | 221/75 |
| 0 333 430 A2 | 9/1989 | European Pat. Off. . | |
| 0 551 284 A1 | 7/1993 | European Pat. Off. . | |
| 29 16 694 C2 | 11/1980 | Germany . | |
| 36 08 942 A1 | 9/1987 | Germany . | |
| 004321095 | 1/1994 | Germany | 221/75 |
| 196 31 931 | 8/1996 | Germany . | |
| 196 06 056 A1 | 8/1997 | Germany . | |
| 196 14 915 A1 | 10/1997 | Germany . | |

OTHER PUBLICATIONS

Matsuda Tetsuo, Dec. 24, 1993, Goods Ejecting Device for Automatic Vending Machine, Patent Abstracts of Japan.

Mita Yoshikazu, Nov. 8, 1990, Automatic Vending Machine, Patent Abstracts of Japan.

*Primary Examiner*—H. Grant Skaggs

*Attorney, Agent, or Firm*—McGlew and Tuttle, P.C.

[57] ABSTRACT

A vending machine including a housing with one or more assembly units and one or more stacking shafts positioned in the housing. The assembly unit include a plurality of product dispensing coils for stacking and dispensing product horizontally. The stacking shaft stacking and dispensing products vertically, especially beverage containers. A support structure extends over a horizontal width of the housing and supports the assembly units and the stacking shafts in horizontally adjacent positions.

20 Claims, 8 Drawing Sheets

VENDING MACHINE

FIELD OF THE INVENTION

The present invention pertains to a vending machine with horizontal product dispensing coils for product packages and a means for dispensing stacked products, especially beverage containers.

BACKGROUND OF THE INVENTION

It has been known that product dispensing coils rotatable around horizontal axes are provided for dispensing product packages, e.g., candies or other snacks. The product packages are located individually between turns of the dispensing coil on a horizontal tray. The product packages are dispensed by the stepped rotation of the coils. Such a means is for example described in the older patent application No. 196 31 931. The dispensing coils are not very suitable for dispensing bottles or cans.

Vertical stacking shafts are usually provided in vending machines for bottles or cans, because this leads to a high storage capacity. Such product shafts are described in, e.g., DE 29 16 694 C2, DE 36 08 942 A1, and the older patent applications 196 06 056 and 196 14 915, especially concerning the dispensing mechanism. Because of the different shapes of the stacking shafts, on the one hand, and of the dispensing coils, on the other hand, separate vending machines are usually set up for bottles or cans, on the one hand, and for "snacks," e.g., candies, on the other hand.

A vending machine from which product packages (snacks) and beverage bottles or cans can be sold is desirable.

A vending machine from which product packages and cans can be sold has been commercially available. The area in which product packages that can be dispensed via dispensing coils and the area in which cans are accommodated are horizontally separated in this vending machine; the areas are consequently located one on top of another. This is unfavorable, because the area accommodating the cans is lower as a result than the product-accommodating height of the vending machine. This leads to a low storage capacity for cans, because the advantage of the prior-art stacking shafts cannot be utilized. It is also unfavorable that a changeover of the vending machine from the dispensing of more product packages to be dispensed via dispensing coils to fewer cans and vice versa is difficult and requires a considerable amount of work for conversion and a large number of new components. Consequently, there is no variability in practice in the splitting of the product storage space of the vending machine between product packages, on the one hand, and cans, on the other hand.

SUMMARY AND OBJECTS OF THE INVENTION

The primary object of the present invention is to propose a vending machine of the type described in the introduction, whose area assigned for receiving stackable products, especially bottles or cans, is utilized at a high storage capacity and in which the splitting into an area for receiving stackable products, especially bottles or cans, and an area for product packages that can be dispensed by means of horizontal dispensing coils, is variable in a simple manner in terms of construction and assembly.

The above object is accomplished according to the present invention by the vending machine including a housing with one or more assembly units and one or more stacking shafts positioned in the housing. The assembly unit including a plurality of product dispensing coils for stacking and dispensing product horizontally. The stacking shaft stacking and dispensing products vertically, especially beverage containers. A support means extends over a horizontal width of the housing and supports the assembly units and the stacking shafts in horizontally adjacent positions.

Depending on the desired pattern of filling, more or fewer assembly units carrying horizontal product dispensing coils, and fewer or more stacking shafts for bottles or cans can be arranged next to each other on the support means. This is easy in terms of construction and assembly, because only stacking shafts and assembly units having dispensing coils must be replaced at the holding means when changing the type of filling of the vending machine, aside from the necessary electrical connections between the drive units of the dispensing coils and of the dispensing mechanisms of the stacking shafts. The entire product dispensing height of the vending machine is available for the assembly units and the stacking shafts, so that prior-art stacking shafts having a high storage capacity for bottles or cans or other stackable products, e.g., cigarette packs or books, can be used. The assembly unit or assembly units, which may extend essentially over the entire product storage height of the vending machine, is/are located next to the stacking shaft or next to the stacking shafts, so that a high product storage capacity is obtained, on the whole, which is also supported by the fact that the product storage width of the vending machine is also utilized. Two or more product dispensing coils may also be arranged next to each other in the assembly unit or assembly units.

Concerning the number of dispensing coils located next to each other, the manufacturer of the vending machine offers the operator of the vending machine different assembly units and stacking shafts, so that the operator can select the desired combination of assembly units carrying the dispensing coils and the stacking shafts.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
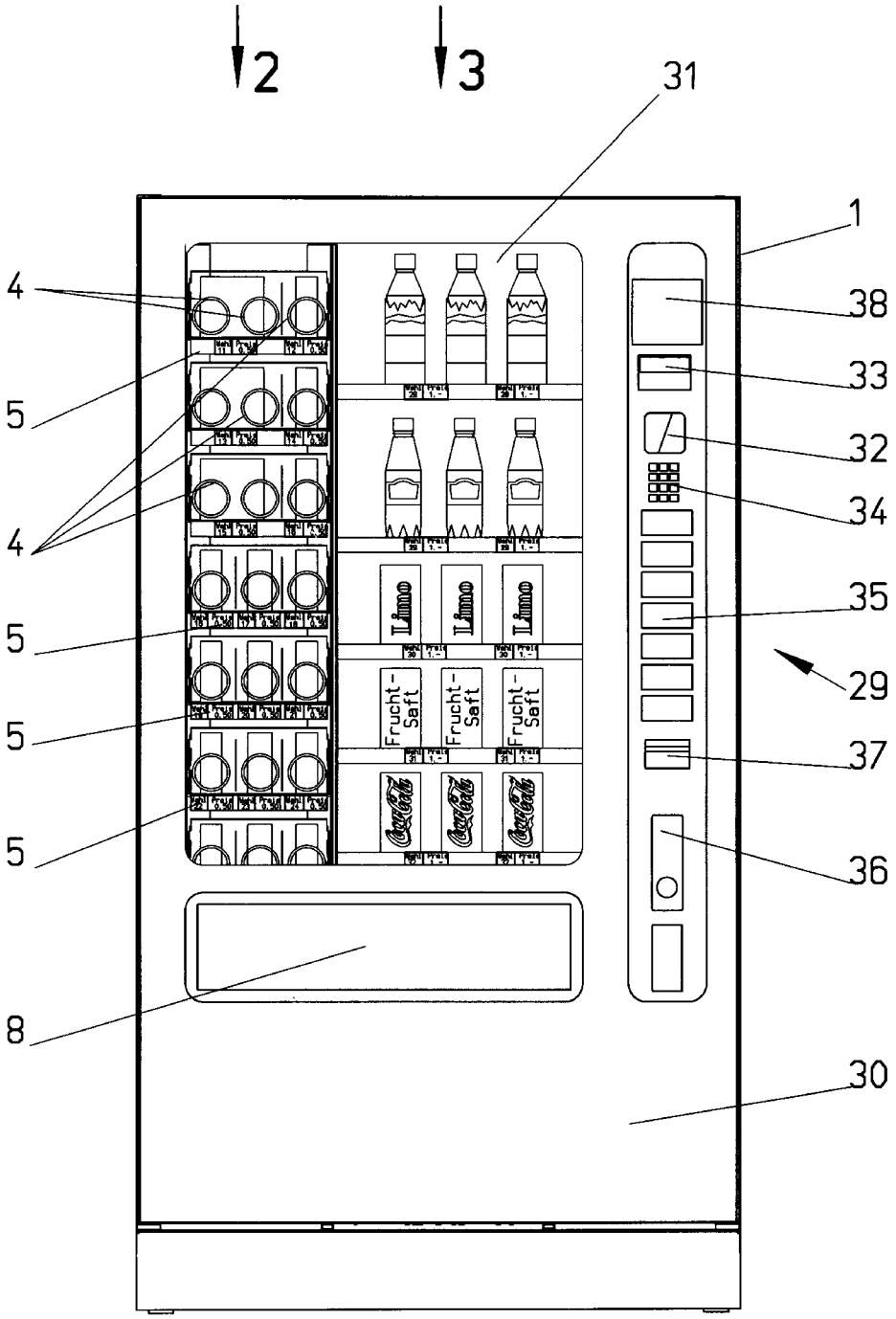
FIG. 1 is a front view of the vending machine with the door closed.

Referring to the drawings, one or more assembly units 2 and one or more stacking shafts 3 are installed horizontally next to each other in a housing 1 of the vending machine. Both the assembly units 2 and the stacking shafts 3 extend essentially over the entire product storage height H of the interior product storage space or area of the vending machine.

Figure 3:
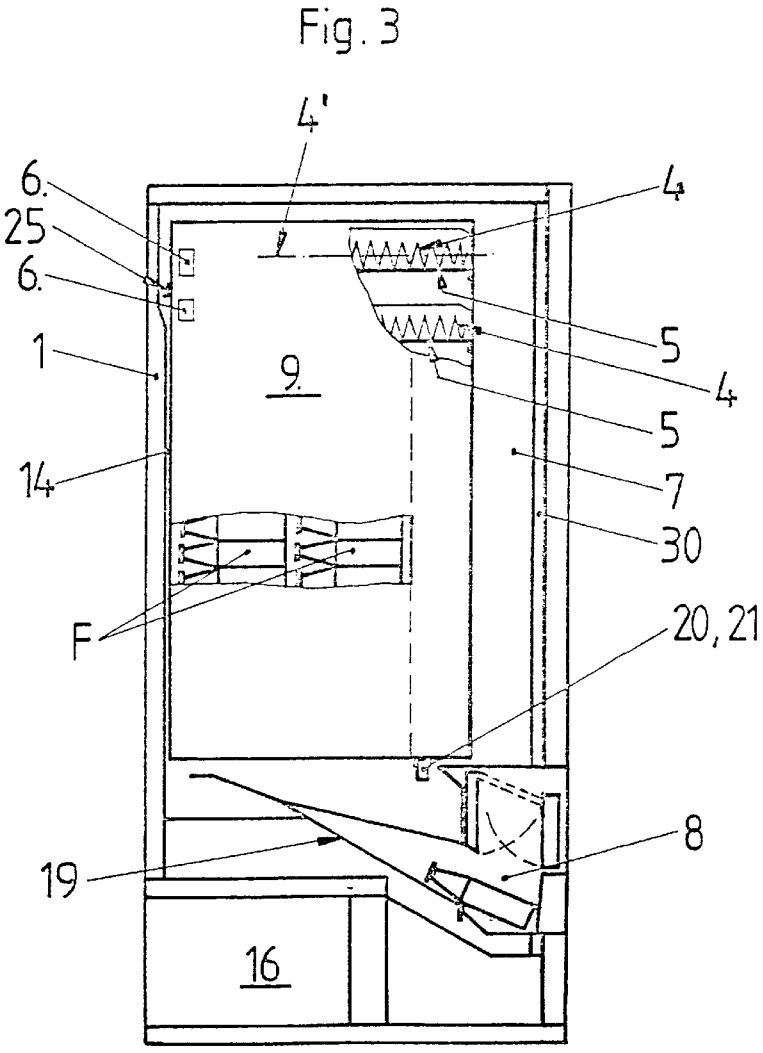
FIG. 3 is a partial sectional side view.

Each assembly unit 2 carries a plurality of product dispensing coils 4, seven in the case of this example, one on top of another, for product packages S of snacks located on trays 5. The dispensing coils 4 are shown in FIGS. 1 and 3, and the product packages S are shown in FIG. 2.

Each coil 4 is rotatable stepwise around its horizontal axis 4' by means of a drive unit 6, wherein the product packages S are moved horizontally in the direction of a drop shaft 7, in which they fall into a dispensing compartment 8 of the vending machine.

Figure 2:
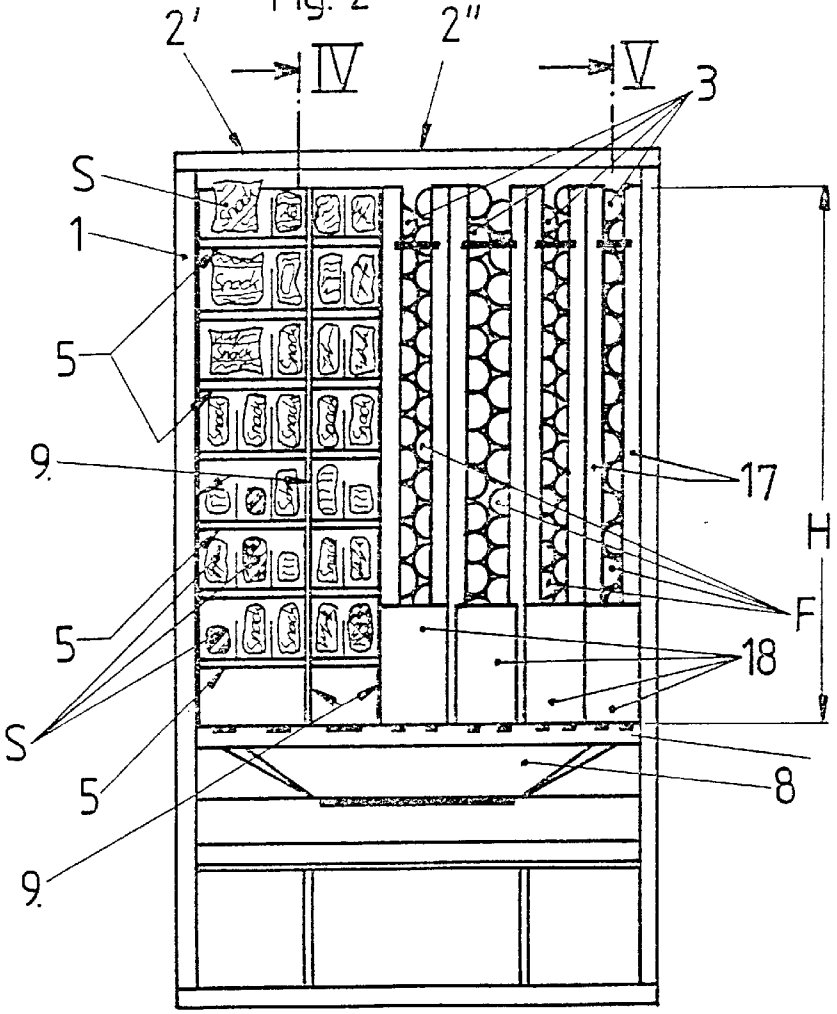
FIG. 2 is a front view with the door open.
Figure 4:
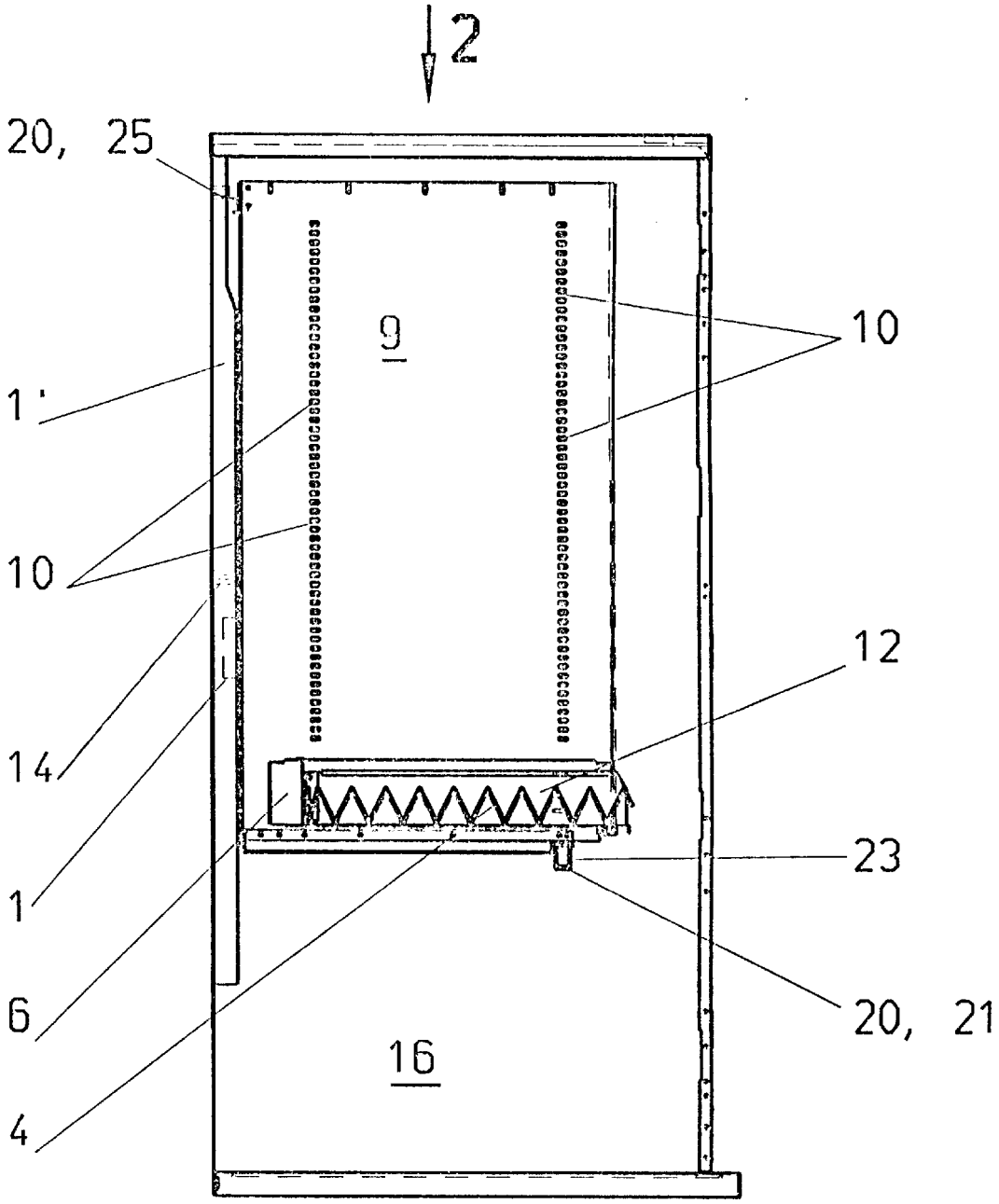
FIG. 4 is a side view in the direction of arrow IV according to FIG. 2.
Figure 5:
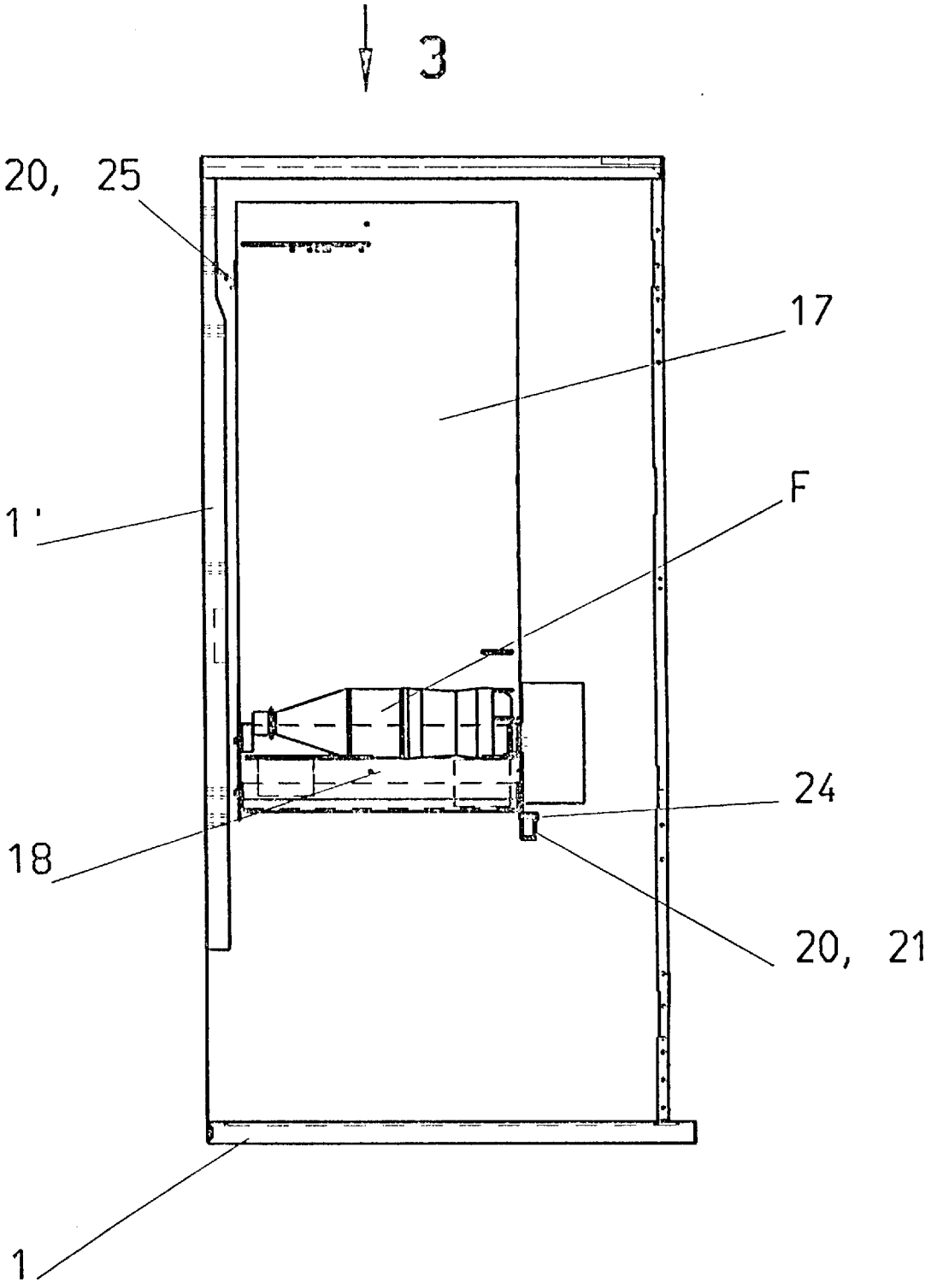
FIG. 5 is a side view in the direction of arrow V according to FIG. 2.
Figure 9:
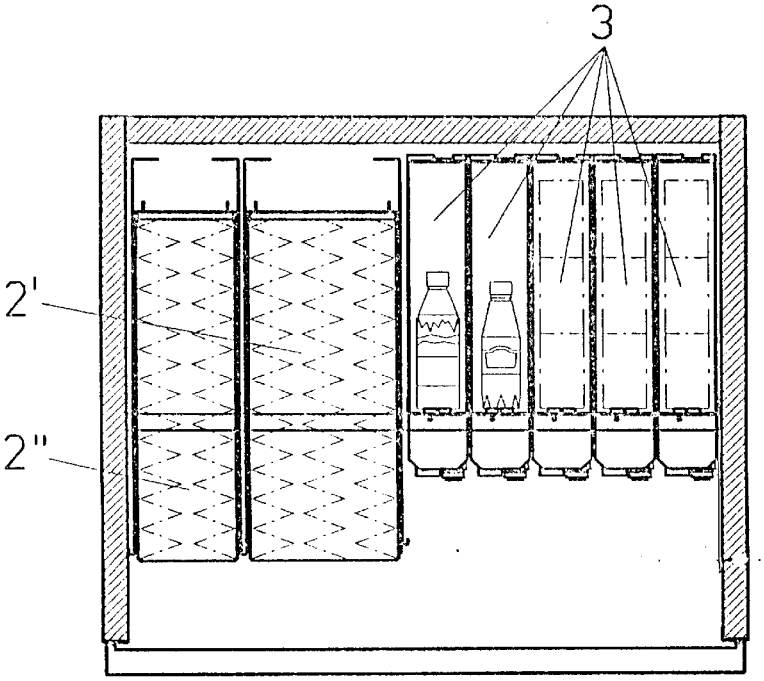

Three dispensing coils 4 are provided next to each other in the case of the assembly unit 2' see FIGS. 2 and 9. Two dispensing coils 4 are provided in the case of the assembly unit 2" see FIGS. 2 and 9.

Figure 13:
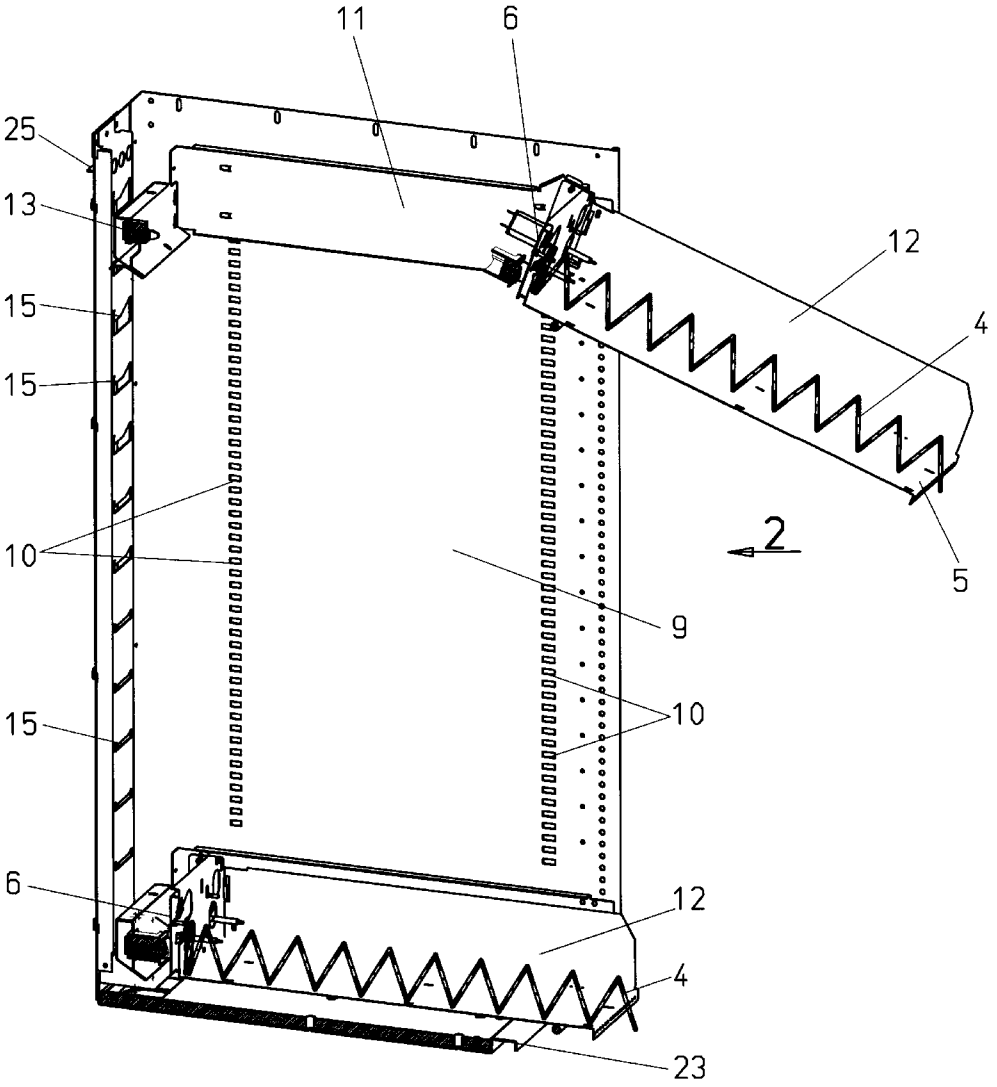
FIG. 13 is a perspective view of the assembly unit according to FIG. 12.
Figure 12:
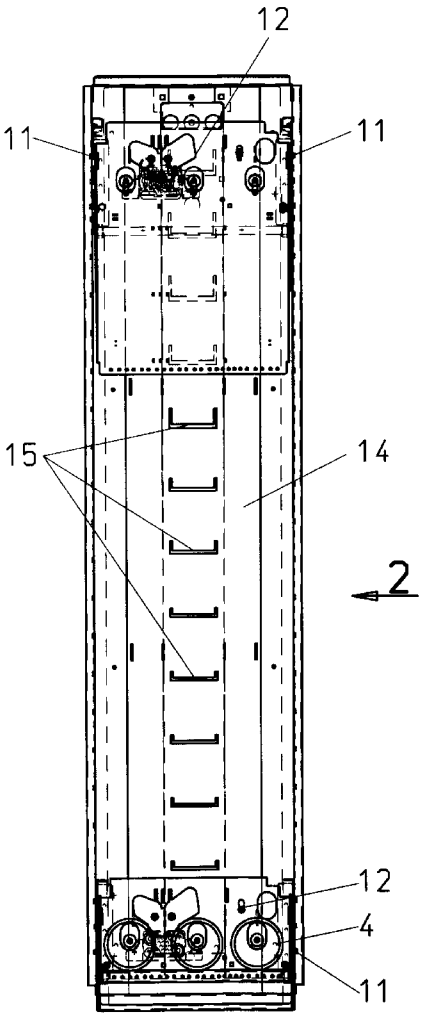
FIG. 12 is a front view of an assembly unit carrying a dispensing coil.

Each assembly unit 2 has two side walls 9, which are provided with a vertical plurality of slotted holes 10. Guide plates 11, which carry the corresponding coil assembly units 12, are inserted into these and are variable in height. Each coil assembly unit 12 has the corresponding dispensing coils 4 located next to each other, their drive unit 6, and the tray 5. The corresponding coil assembly unit 12 can be pulled out horizontally at the guide plates 11 for filling by a sliding means and is tiltable in its pulled-out position. This is shown in FIG. 13 for the upper coil assembly unit 12. An electric plug-and-socket connection 13 of the drive units 6 is disconnected during the pulling out. The plug-and-socket connection 13 closes during the pushing in see FIG. 13, bottom. The coil assembly units arranged between the upper and lower coil assembly units are not shown in FIGS. 12 and 13 for simplification of the representation. Due to the plurality of slotted holes 10, it is possible to suspend the guide plates 11 of the coil assembly units 12 in the side walls 9 corresponding to the height of the corresponding product packages S.

Straps 15, which guide cooling air to the product packages from a cooling unit arranged in a space 16 of the vending machine, are bent out at a rear wall 14 of the assembly unit 2.

Each stacking shaft 3 for bottles or cans F has two connected side walls 17. A prior-art rocker 18 driven by an electric motor is arranged at the bottom at each stacking shaft 3 for dispensing the bottles or cans. One or two pairs of bottles or cans are to be accommodated offset in the stacking shaft 3, as is also known per se. It is also possible to provide the stacking shafts for other stackable products, e.g., cigarette packs or books.

Figure 8:
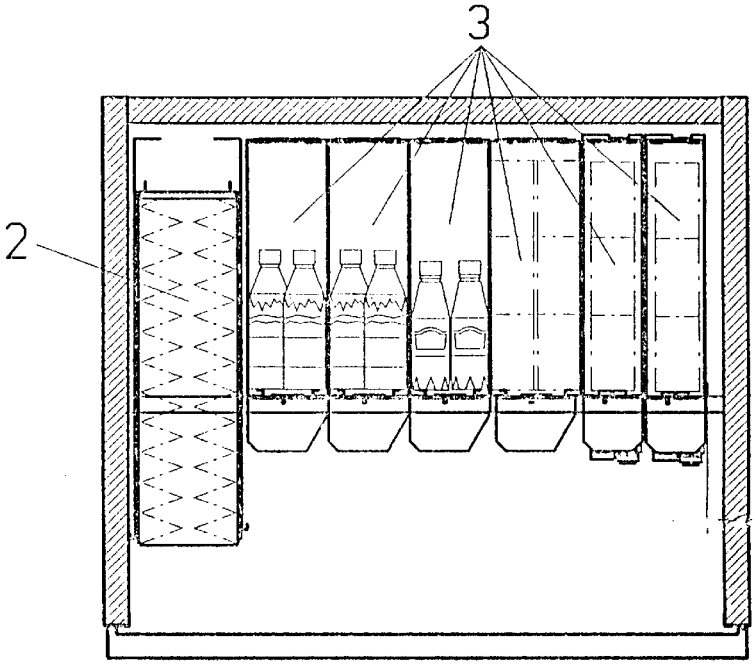
FIGS. 8 and 9 are top views of different embodiment variations of the vending machine.

A sliding surface 19 extends obliquely to the rear and upward from the dispensing compartment 8 such that bottles or cans dispensed slide into the dispensing compartment 8 see FIG. 3. The stacking shafts 3 may have different widths, depending on the diameter of the bottles or cans see FIGS. 2 and 8.

Figure 7:
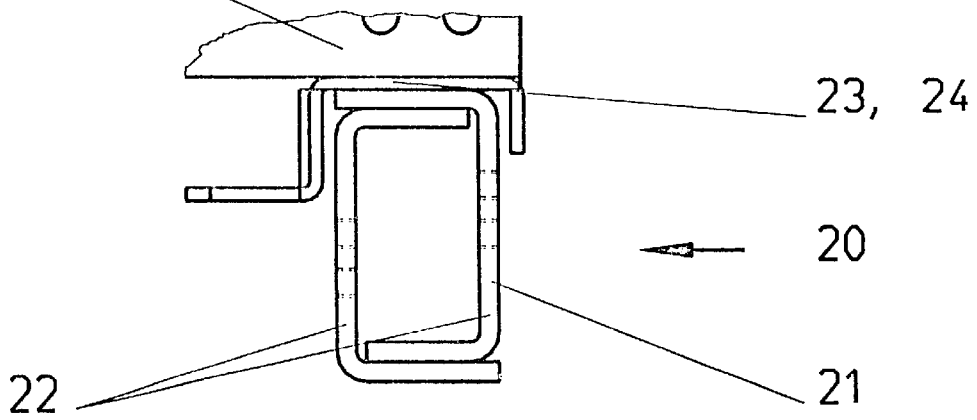

A support means 20 for the assembly units 2 and the stacking shafts 3 is arranged in the housing 1 of the vending machine. This has a horizontal cross member 21, which extends essentially over the width of the vending machine. The cross member 21 consists of a square profile, which is composed of two U sections in the case of the example see FIG. 7. The cross member 21 is arranged under the assembly units 2 and the stacking shafts 3 in their front areas and above the dispensing compartment 8. It is used to support the weight of the assembly units 2 and of the stacking shafts 3. To secure these against sliding in the forward or rearward direction at the cross member 21 at right angles to the horizontal longitudinal direction width of the vending machine, U-shaped elbows 23, which can be placed on the cross member 21, are fastened to the assembly units 2. Identical elbows 24 are fastened to the stacking shafts 3 for the same reason. The assembly units and the stacking shafts can be displaced on the cross member 21 in the longitudinal direction of the said cross member.

Figure 6:
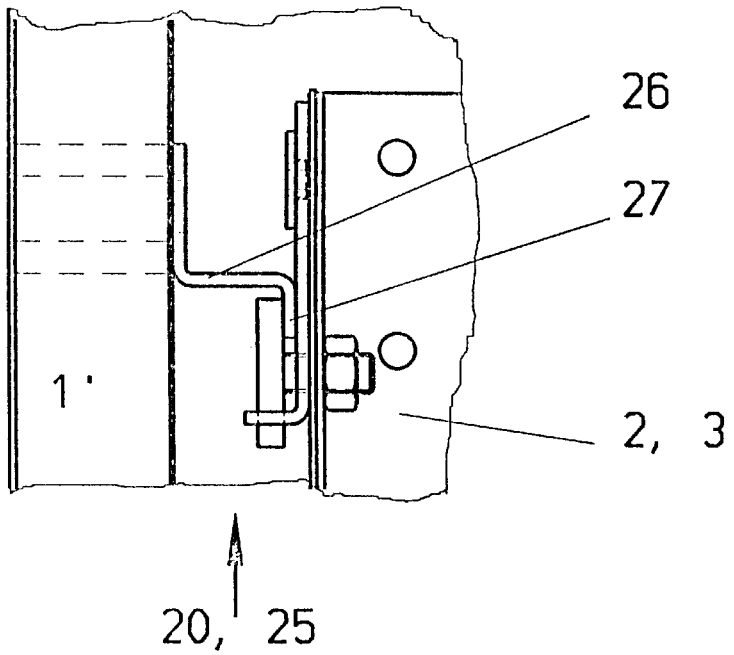
FIG. 6 and FIG. 7 are detail views of the support means.

Besides the cross member 21, the support means 20 has a bracket 25, which is provided at the top, especially in the top rear area, at the assembly units 2 and the stacking shafts 3. According to FIG. 6, the bracket 25 is a Z-shaped, horizontally continuous rail 26, which is fastened to the rear wall 1' of the housing 1 and at which the assembly units 2 and the stacking shafts 3 can be fastened by means of fastening elements 27, so that the assembly units 2 and the stacking shafts 3 cannot tilt forward unintentionally. In the embodiment according to FIGS. 10 and 11, the rail 26 extends only in the area of the stacking shaft 3. The assembly unit 2 is fastened to the housing 1 at the top with elbows 28.

The assembly units 2, 2', 2" and the stacking shafts 3 may be inserted into the vending machine in different combinations, depending on the desire of the operator of the vending machine. The operator selects the desired combination of assembly units 2 and stacking shafts 3 and places the assembly units 2 and the stacking shafts 3 on the cross member 21, establishes the connection to the bracket 25, and establishes the necessary electrical connections of the drive units 6, 18.

FIGS. 1, 2, 8 through 11 show different outfit variants. According to FIG. 1, a single assembly unit 2 carrying product dispensing coils 4, which has three dispensing coils 4 next to each other, and five stacking shafts 3 for different beverages are provided. In the embodiment according to FIG. 8 there is provided, one assembly unit 2 which carries seven dispensing coils 4 one on top of another in a column and with two columns of these dispensing coils 4 positioned next to each other in pairs, and six stacking shafts 3, two of which are narrower than the others.

In the variant according to FIG. 9, two assembly units 2', 2" are provided next to each other, and the two assembly units are of equal height, but two dispensing coils 4 are provided next to each other in one assembly unit and three dispensing coils 4 are provided next to each other in the other assembly unit, and five narrow stacking shafts 3 are installed.

Figure 11:
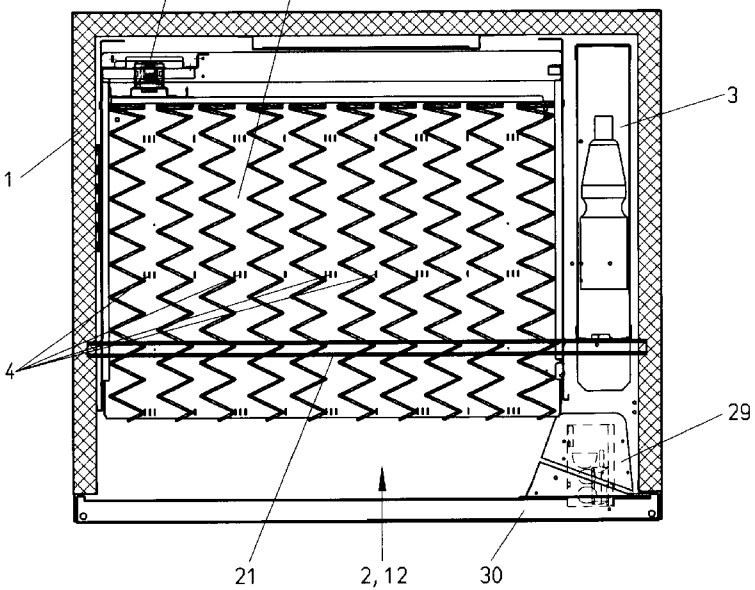
FIG. 11 is a top view of the embodiment according to FIG. 10.
Figure 10:
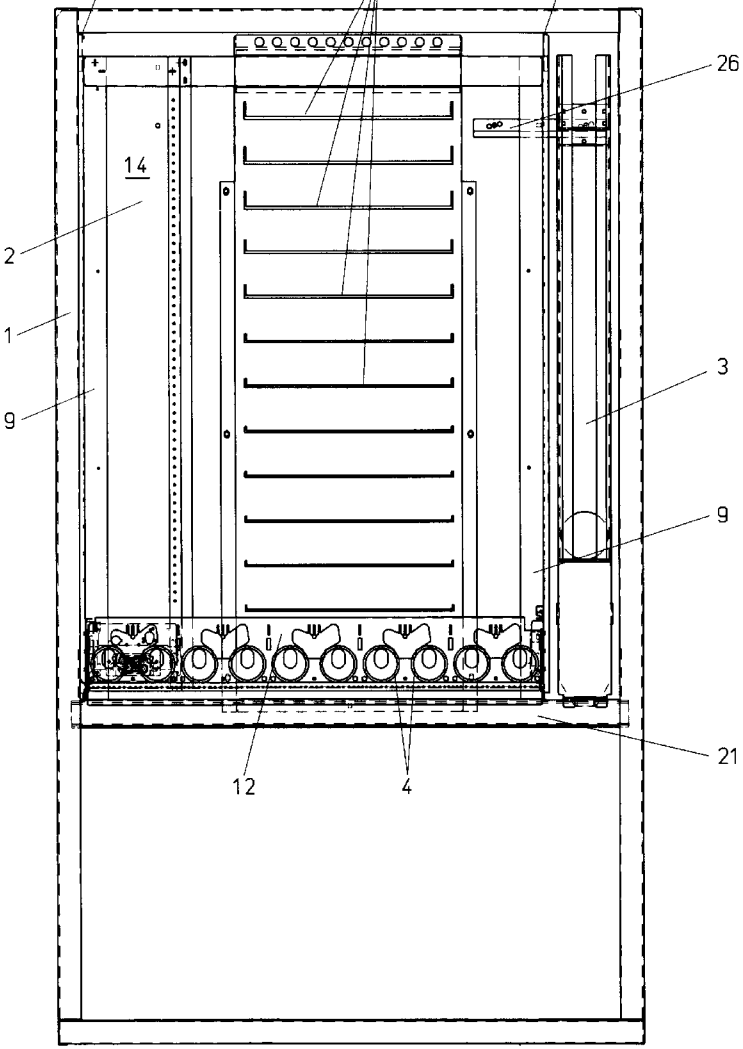
FIG. 10 is a front view of another embodiment.

A single assembly unit 2 with 10 product dispensing coils 4 located next to each other and a single stacking shaft 3 are provided in the variant according to FIGS. 10 and 11. This stacking shaft 3 is located behind an operating and control means 29 of the vending machine. The operating and control means is fastened to the door 30 of the vending machine. This arrangement is possible because sufficient space is available for accommodating a stacking shaft 3 behind the operating and control means 29 in the housing 1. This space cannot be equipped with dispensing coils 4, because these coils should be visible through a glass front panel 31 of the door 30. However visibility is unnecessary for the stacking shafts 3.

Instead of the stacking shaft 3, it is also possible to insert a shelf compartment, which is used to store more "snacks," for which there was no more space in the dispensing coils during filling.

Only one coil assembly unit 12 of the assembly unit 2 is shown in FIGS. 10 and 11 for simplification of the representation. Slots, into which partitions extending between the coils 4 may be inserted when needed, are shown at the tray 5 between the dispensing coils 4.

The operating and control means 29, has, in the usual manner, on the user side, a coin slot 32, a display means 33, selection keys 34, sorting signs 35, a closing flap 36 for the door 30, a coin return 37, and a "Point of Sale (POS) window" 39 for receiving customer/product information, as shown in FIG. 1. The customer selects the desired product by means of the selection keys 34. In case of a corresponding credit, the operating and control means 29 energizes the corresponding drive unit 6 or the corresponding rocker 18, so that the desired product will arrive at the product dispensing compartment.

It is indicated in FIG. 1 that the glass front panel 31 of the door 30 is transparent at the assembly unit 2 only. The glass front panel 31 is covered in the area of the stacking shafts 3, and the cover 38 symbolically represents the bottled or canned beverages being stored in the stacking shafts 3 or it carries advertising posters and is backlit. This is favorable, because transparency of the glass front panel 31 in the area of the stacking shafts 3 would only show the bottle or can bottoms which are unidentifiable by a user. Instead of the cover, it is also possible to use a shelf system, which is used to hold and display the original bottles or cans. These bottles or cans are then visible to the customer from the outside.

While specific embodiments of the invention have been shown and described in detail to illustrate the application of the principles of the invention, it will be understood that the invention may be embodied otherwise without departing from such principles.

What is claimed is:

1. A vending machine comprising:

a housing;

an assembly unit positioned in said housing, said assembly unit including a plurality of product dispensing coils;

a stacking shaft positioned in said housing and receiving a vertically stacked products;

support means extending over a horizontal width of said housing and for supporting said assembly unit and said stacking shaft in horizontally adjacent positions.

2. A vending machine in accordance with claim 1, wherein:

said plurality of product dispensing coils are arranged vertically one on top of another, each said product dispensing coil being positioned axially horizontally and shaped for dispensing product packages, a plurality of said assembly units are arranged in said housing;

said stacking shaft is shaped to hold vertically stacked beverage containers, a plurality of said stacking shafts are arranged in said housing;

said plurality of said assembly units and stacking shafts are fastened to said support means.

3. A vending machine in accordance with claim 2, wherein:

said assembly unit and said stacking shaft are fastenable to said support means at a plurality of positions on said support means.

4. A vending machine in accordance with claim 1, wherein:

said housing includes a product storage height;

said assembly unit and said stacking shaft occupy substantially all of said product storage height of said housing.

5. A vending machine in accordance with claim 1, wherein:

said dispensing coils are arranged vertically into a column.

6. A vending machine in accordance with claim 1, wherein:

said dispensing coils are arranged vertically into a plurality of columns.

7. A vending machine in accordance with claim 1, wherein:

said assembly unit includes means for rotating said dispensing coils about a horizontal axis of rotation, said assembly unit is designed to store stacks of products in a direction substantially parallel to said horizontal axis of rotation of said dispensing coils.

8. A vending machine in accordance with claim 1, wherein:

said housing includes a single dispensing compartment for receiving products dispensed from both said assembly unit and said stacking shaft.

9. A vending machine in accordance with claim 1, wherein:

an operating and control unit is arranged in said housing;

one of said stacking shaft or a shelf compartment is arranged adjacent said operating and control unit.

10. A vending machine in accordance with claim 1, wherein:

said support means has a horizontal cross member;

said assembly unit and said stacking shaft being arranged in contact with and on top of said cross member.

11. A vending machine in accordance with claim 10, wherein:

said support means includes a bracket;

a top of said assembly unit and said stacking shaft being fastened to said bracket.

12. A vending machine in accordance with claim 1, wherein:

said support means includes a bracket;

a top of said assembly unit and said stacking shaft being fastened to said bracket.

13. A vending machine in accordance with claim 1, wherein:

said assembly unit includes side walls and guide plates fastenable to said side walls, said assembly unit includes a coil unit which includes a tray and one of said plurality of product dispensing coils, said coil unit being connected to said guide plate.

14. A vending machine in accordance with claim 13, wherein:

said guide plate and said coil unit includes sliding means for moving said coil unit relative to said side wall.

15. A vending machine in accordance with claim 13, wherein:

said guide plate and said side wall include means for variably positioning said guide plate and said coil unit on said side wall in a height variable manner.

16. A vending machine in accordance with claim 1, wherein:

said assembly unit has means for dispensing product horizontally and said stacking shaft has means for dispensing product vertically.

17. A vending machine in accordance with claim 1, wherein:

said assembly unit and said stacking shaft are variably positionable along an entire length of said support means.

18. A vending machine comprising:

a housing;

a stacking shaft positioned in said housing and receiving vertically stacked products;

an assembly unit positioned in said housing, said assembly unit including a plurality of product dispensing coils positioned axially horizontally and shaped for dispensing product packages substantially horizontally, said plurality of product dispensing coils are arranged vertically one on top of another to a height substantially equal to a height of said stacking shaft;

support means extending over a horizontal width of said housing and for interchangeably supporting both said assembly unit and said stacking shaft in horizontally adjacent and adjustable positions.

19. A vending machine in accordance with claim 18, wherein:

said housing includes a product storage area for storing substantially all of the stacked product and product packages;

said assembly unit and said stacking shaft having a height substantially equal to a height of said product storage area.

20. A vending machine in accordance with claim 18, wherein:

said stacking unit is shaped to hold one of cigarette packs and books.

* * * * *